US008172518B2

(12) United States Patent
Ruehr et al.

(10) Patent No.: US 8,172,518 B2
(45) Date of Patent: May 8, 2012

(54) METHODS AND APPARATUS FOR FABRICATING A ROTOR ASSEMBLY

(75) Inventors: William Carl Ruehr, Cincinnati, OH (US); Michael Harvey Schneider, Loveland, OH (US); Sunil Kumar Sinha, Cincinnati, OH (US); Jay L. Cornell, Hamilton, OH (US)

(73) Assignee: General Electric Company, Schenectady, NY (US)

( * ) Notice: Subject to any disclaimer, the term of this patent is extended or adjusted under 35 U.S.C. 154(b) by 340 days.

(21) Appl. No.: 11/617,911

(22) Filed: Dec. 29, 2006

(65) Prior Publication Data

US 2008/0159869 A1 Jul. 3, 2008

(51) Int. Cl.
*F01D 11/08* (2006.01)
*F01D 5/20* (2006.01)

(52) U.S. Cl. ..... 415/173.4; 416/228; 416/237; 29/889.1; 29/889.23; 29/889.7; 29/889.21

(58) Field of Classification Search ..... 415/9, 173.1, 415/173.4, 173.5, 174.4, 174.5; 416/228, 416/237; 29/889.1, 889.21, 889.7, 889.23
See application file for complete search history.

(56) References Cited

U.S. PATENT DOCUMENTS

| | | | | |
|---|---|---|---|---|
| 4,274,806 | A * | 6/1981 | Gallardo, Jr. | 415/173.4 |
| 4,390,320 | A | 6/1983 | Eiswerth | |
| 4,874,290 | A * | 10/1989 | Cang et al. | 415/173.4 |
| 4,957,411 | A * | 9/1990 | Girault | 415/173.4 |
| 5,274,999 | A * | 1/1994 | Rohra et al. | 60/226.1 |
| 5,551,840 | A | 9/1996 | Benoit et al. | |
| 5,603,603 | A | 2/1997 | Benoit et al. | |
| 6,095,755 | A | 8/2000 | Houston | |
| 6,234,747 | B1 * | 5/2001 | Mielke et al. | 415/119 |
| 6,568,909 | B2 | 5/2003 | Szucs et al. | |
| 6,652,222 | B1 * | 11/2003 | Wojtyczka et al. | 415/9 |
| 6,652,235 | B1 | 11/2003 | Keith et al. | |
| 6,851,926 | B2 * | 2/2005 | Guinessine et al. | 415/173.1 |
| 6,877,956 | B2 | 4/2005 | Gazzillo et al. | |
| 6,984,107 | B2 | 1/2006 | Grunke et al. | |
| 7,144,221 | B2 | 12/2006 | Giffin | |
| 2006/0090336 | A1 * | 5/2006 | Graham et al. | 29/889.1 |

FOREIGN PATENT DOCUMENTS

GB 2052644 A 1/1981

OTHER PUBLICATIONS

European Patent Office, International Search Report for Application No. 07123246.6, Oct. 4, 2010, 6 pages, EP.

* cited by examiner

*Primary Examiner* — Christopher Verdier
(74) *Attorney, Agent, or Firm* — David J. Clement, Esq.; Armstrong Teasdale LLP

(57) ABSTRACT

A method for assembling a rotor assembly and a rotor assembly are provided. The method comprises providing a rotor blade including a first sidewall, a second sidewall, where the first and second sidewalls are connected at a leading edge and a trailing edge and extend in span from a root portion to a tip portion, removing blade material from the tip portion to form a tip portion rake angle that enables the tip portion to extend obliquely between the first and second sidewalls, and coupling the rotor blade to a shaft such that during tip rubs the tip portion rake angle facilitates reducing radial loading induced to the blade during tip rubs.

10 Claims, 5 Drawing Sheets

METHODS AND APPARATUS FOR FABRICATING A ROTOR ASSEMBLY

BACKGROUND OF THE INVENTION

This application relates generally to gas turbine engine rotor blades and, more particularly, to methods and apparatus for fabricating a rotor assemblies.

Known gas turbine engine compressor rotor blades include airfoils having a leading edge, a trailing edge, a pressure side, a suction side, a root portion, and a tip portion. The pressure and suction sides connect at the airfoil leading and trailing edges, and span radially between the root and tip portions. An inner flow-path is defined at least partially by the root portion, and an outer flow-path is defined at least partially by a stationary casing coupled radially outward from the rotor blades. At least some known stationary casings include an abradable material that is spaced circumferentially within the casing and radially outward from the blade tip portion. At least some known compressors, for example, include a plurality of rows of rotor blades that extend radially and orthogonally outward from a rotor disk.

At least some known compressor rotor blades are coupled in a converging flow-path that may be susceptible to high airfoil radial loading and vibratory stresses generated by blade dynamic responses if the airfoil tips rub against the abradable casing. More specifically, such loading and stresses may be generated as a result of the rotor blade deflecting and rubbing the abradable casing. The blade dynamic response generally causes the airfoils to assume a first flex mode shape which results in high airfoil stresses at a peak location near the root portion of the airfoil. Moreover, generally the effect of tip rubs may be more severe to the airfoil when the suction side contacts the abradable casing rather than the pressure side.

BRIEF DESCRIPTION OF THE INVENTION

In one aspect, a method for assembling a rotor assembly is provided. The method comprises providing a rotor blade including a first sidewall, a second sidewall, where the first and second sidewalls are connected at a leading edge and a trailing edge and extend in span from a root portion to a tip portion, removing blade material from the tip portion to form a tip portion rake angle that enables the tip portion to extend obliquely between the first and second sidewalls, and coupling the rotor blade to a shaft such that during tip rubs the tip portion rake angle facilitates reducing radial loading induced to the blade during tip rubs.

In another aspect, an airfoil for use in a rotor assembly is provided. The airfoil comprises a first sidewall, a second sidewall coupled to the first sidewall at a leading edge and at a trailing edge, a root portion, and a tip portion extending obliquely between the first and second sidewalls at an angle that facilitates reducing radial loading induced to the airfoil during tip rubs.

In a further aspect, a rotor assembly for use in a gas turbine engine is provided. The rotor assembly comprises a rotor shaft, and a plurality of rotor blades coupled to the rotor shaft such that each rotor blade comprises an airfoil portion comprising a first sidewall, a second sidewall coupled to the first sidewall at a leading edge and at a trailing edge, a root portion, and a tip portion extending obliquely between the first and second sidewalls at an angle that facilitates reducing radial loading induced to the airfoil during tip rubs.

DETAILED DESCRIPTION OF THE INVENTION

The present invention provides an exemplary apparatus and method for fabricating a compressor rotor blade for a gas turbine engine. Specifically, in the exemplary embodiment, a booster compressor rotor blade is provided that includes a first sidewall, a second sidewall, a root portion and a tip portion. In the exemplary embodiment, the tip portion is oriented to facilitate reducing radial and axial loads induced to the rotor blade during pre-defined engine operations.

Although the present invention described herein is described in connection with the turbine engine shown in FIG. 1, it should be apparent to those skilled in the art and guided by the teachings herein provided that with appropriate modification, the apparatus and method of the present invention can also be suitable for any engine with compressors capable of operating as described herein.

Figure 1:
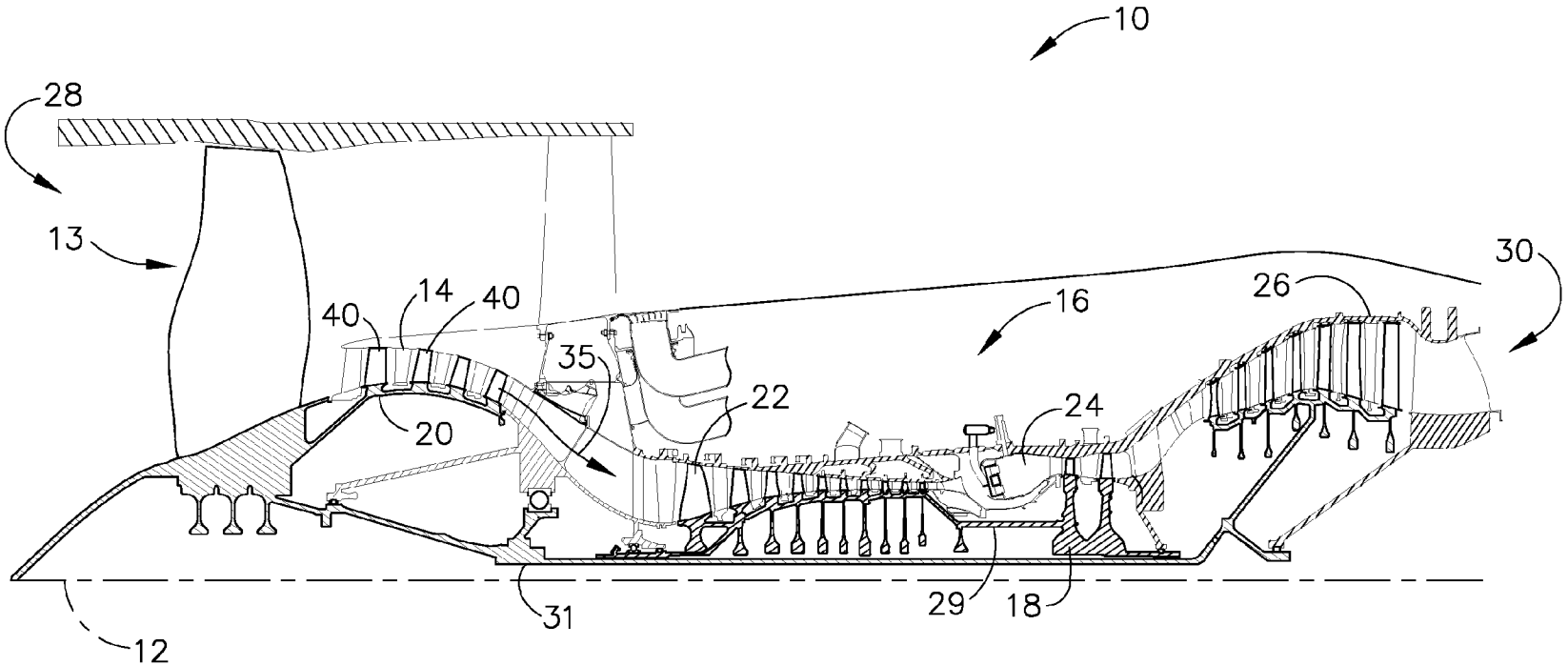
FIG. 1 is a schematic illustration of an exemplary gas turbine engine.

FIG. 1 is a schematic illustration of an exemplary engine assembly 10 having a longitudinal axis 12. Engine assembly 10 includes a fan assembly 13, a booster compressor 14, a core gas turbine engine 16, and a low-pressure turbine 26 that is coupled with fan assembly 13 and booster compressor 14. Core gas turbine engine 16 includes a high-pressure compressor 22, a combustor 24, and a high-pressure turbine 18. Booster compressor 14 includes a plurality of rotor blades 40 that extend substantially radially outward from a rotor disk 20 coupled to a first drive shaft 31. Engine assembly 10 has an intake side 28 and an exhaust side 30. Compressor 22 and high-pressure turbine 18 are coupled together by a second drive shaft 29.

During operation, air enters engine 10 through intake side 28 and flows through fan assembly 13 and compressed air is supplied from fan assembly 13 to booster compressor 14 and high pressure compressor 22. The plurality of rotor blades 40 compress the air and deliver the compressed air to core gas turbine engine 16. Airflow is further compressed by the high-pressure compressor 22 and is delivered combustor 24. Airflow from combustor 24 drives rotating turbines 18 and 26 and exits gas turbine engine 10 through exhaust side 30.

Figure 2:
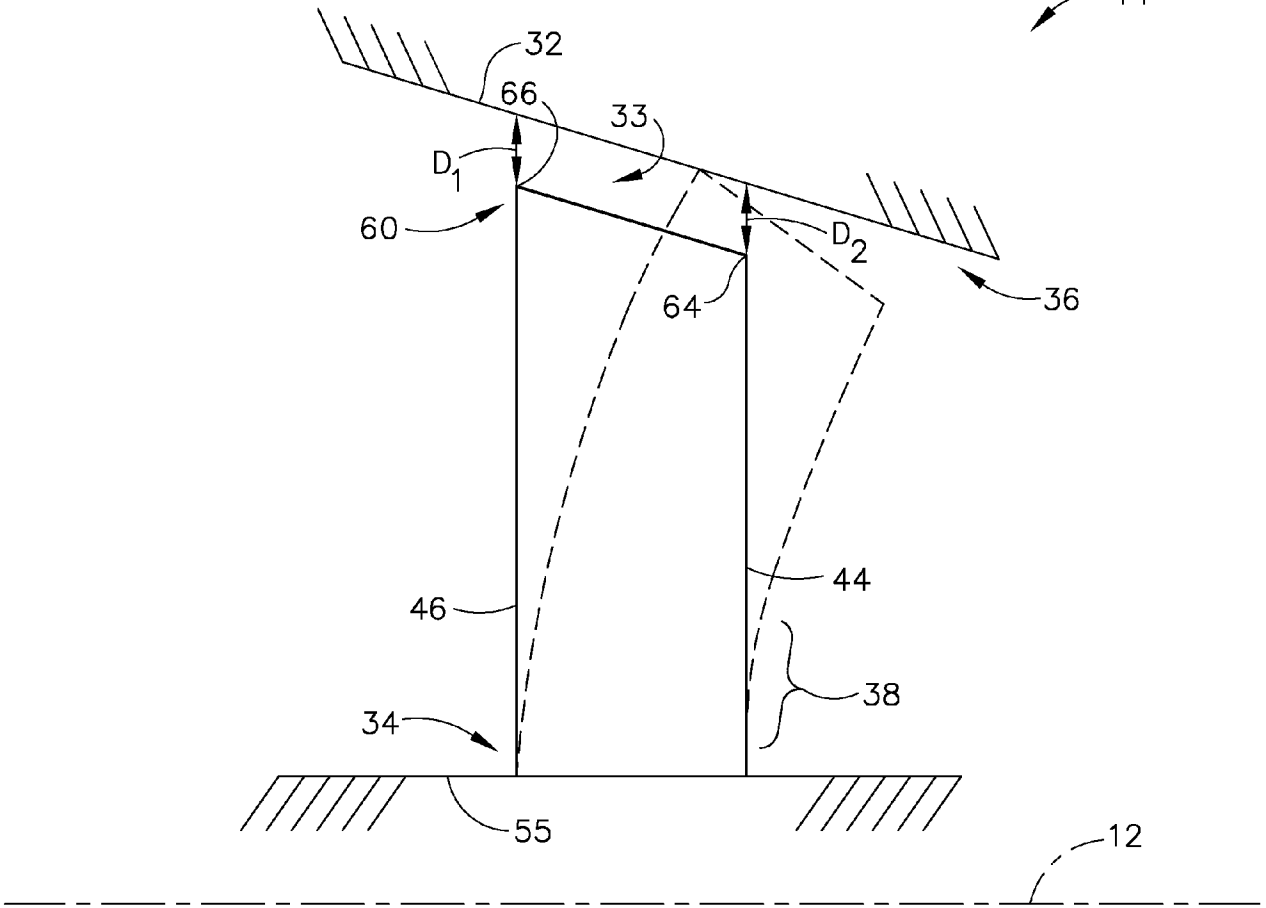
FIG. 2 is a cross-sectional illustration of an orthogonal rotor blade that may be used with the gas turbine engine shown in FIG. 1.
Figure 3:
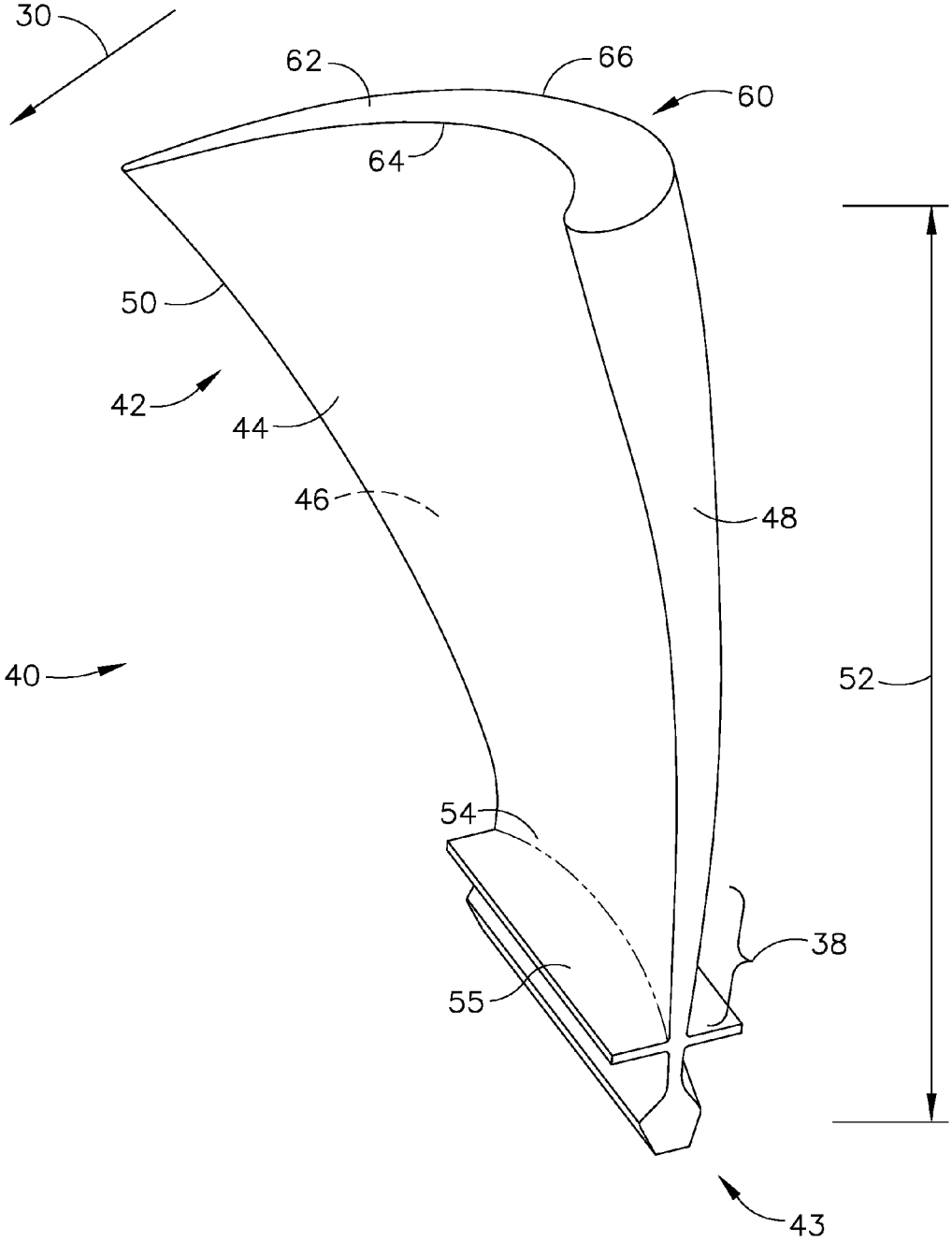
FIG. 3 is a perspective view of a portion of the rotor blade shown in FIG. 2.

FIG. 2 is a cross-sectional view of an exemplary rotor blade 40 that may be used in booster compressor 14 (shown in FIG. 1). FIG. 3 is a perspective view of a portion of rotor blade 40. Rotor blade 40 includes an airfoil portion 42, a platform portion 55, and an integral dovetail portion 43 that is used for mounting rotor blade 40 to rotor disk 20. Airfoil portion 42 includes a first contoured sidewall 44 and a second contoured sidewall 46. In the exemplary embodiment, first sidewall 44 is substantially concave and defines a pressure side of rotor blade 40, and second sidewall 46 is substantially convex and defines a suction side of rotor blade 40. Sidewalls 44 and 46 are joined together at a leading edge 48 and at an axially-spaced trailing edge 50. Trailing edge 50 is spaced chord-wise and downstream from leading edge 48. First and second sidewalls 44 and 46, respectively, each extend longitudinally or radially outward in a span 52 from a blade root portion 54 positioned adjacent dovetail 43, to a blade tip portion 60. Tip portion 60 is defined between sidewalls 44 and 46 and includes a tip surface 62, a concave edge 64, and a convex edge 66. Dovetail portion 43 includes a platform 55 positioned at root portion 54 and extending circumferentially outward from first and second sidewalls 44 and 46, respectively. In the exemplary embodiment, dovetail 43 is positioned substantially axially adjacent root portion 54. In an alternative embodiment, dovetail 43 may be positioned substantially circumferentially adjacent root portion 54. Rotor blade 40 may have any conventional form, with or without dovetail 43 or platform 55. For example, rotor blade 40 may be formed integrally with the disk in a blisk-type configuration that does not include dovetail 43 and platform 55.

In the exemplary embodiment, an abradable material 32 is coupled to a casing circumferentially about rotor blades 40. Platform 55 defines an inner boundary 34 of a flow-path 35 extending through booster compressor 14, and abradable material 32 defines a radially outer boundary 36 of flow-path 35. In an alternative embodiment, inner boundary 34 may be defined by a rotor disk 20 (shown in FIG. 1). Material 32 is spaced a distance D1 and D2 from each rotor blade tip portion 60 such that a clearance gap 33 is defined between material 32 and blades 40. Specifically abradable material 32 is spaced a distance D1 from convex edge 66 and a distance D2 from concave edge 64. In the exemplary embodiment, clearance gap 33 is substantially circumferentially uniform and distance D1 and distance D2 are substantially equal. Distances D1 and D2 are selected to facilitate preventing tip rubs between rotor blades 40 and material 32 during engine operation. In the exemplary embodiment, because blade 40 is an orthogonal rotor blade, the inner boundary 34 of flow-path 35 is not parallel to the outer boundary 36 of flow-path 35 and stacking axis 80 is also not perpendicular to outer boundary 36.

During normal engine operations, rotor disk 20 rotates within an orbiting diameter that is substantially centered about longitudinal axis 12. Accordingly, rotor blades 40 rotate about longitudinal axis 12 such that clearance gap 33 is substantially maintained and more specifically such that tip portion 60 remains a distance D1 from abradable material 32, with the exception of minor variations due to small engine 10 imbalances. Clearance gap 33 is also sized to facilitate reducing an amount of air i.e., tip spillage, that may be channeled past tip portion 60 during engine operation.

In the event of a deflection of blade 40, as shown hidden in FIG. 2, tip portion 60 may rub abradable material 32 such that convex edge 66 contacts abradable material 32 rather than concave edge 64. During such tip rubs, convex edge 66 may not cut abradable material 32 but may rather be jammed into abradable material 32, such that radial and axial loads may be induced to rotor blade 40. Frequent tip rubs of this kind may increase the radial loads and blade vibrations subjected to rotor blade 40. Such loading and vibratory stresses may increase and perpetuate the dynamic stresses of blade 40, which may subject the airfoil portion 42 to material fatigue. Over time, continued operation with material fatigue may cause blade cracking at a first flex stress region 38 and/or shorten the useful life of the rotor blade 40.

Figure 4:
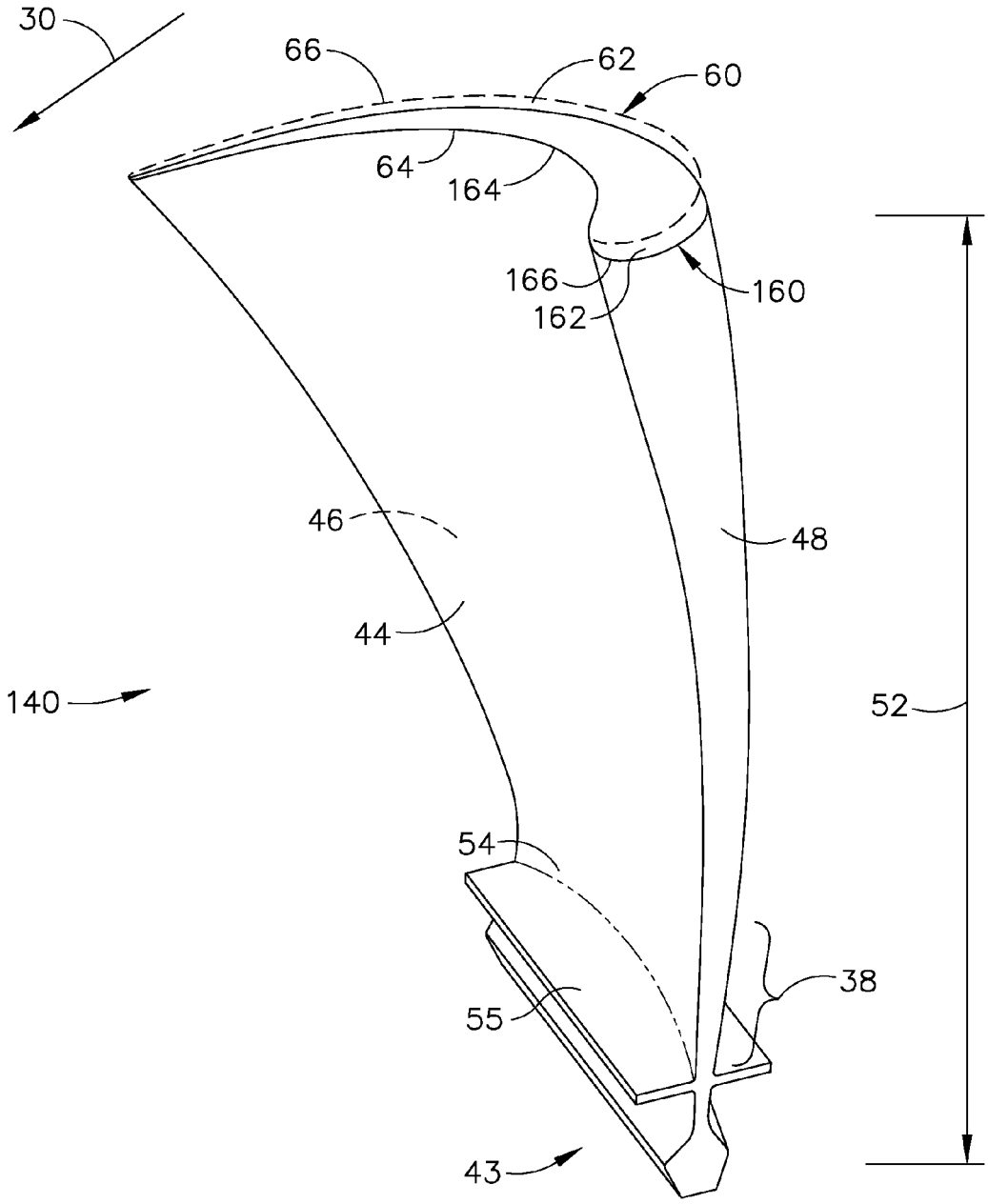
FIG. 4 is a perspective view of the rotor blade shown in FIG. 3 and including a modified tip portion.
Figure 5:
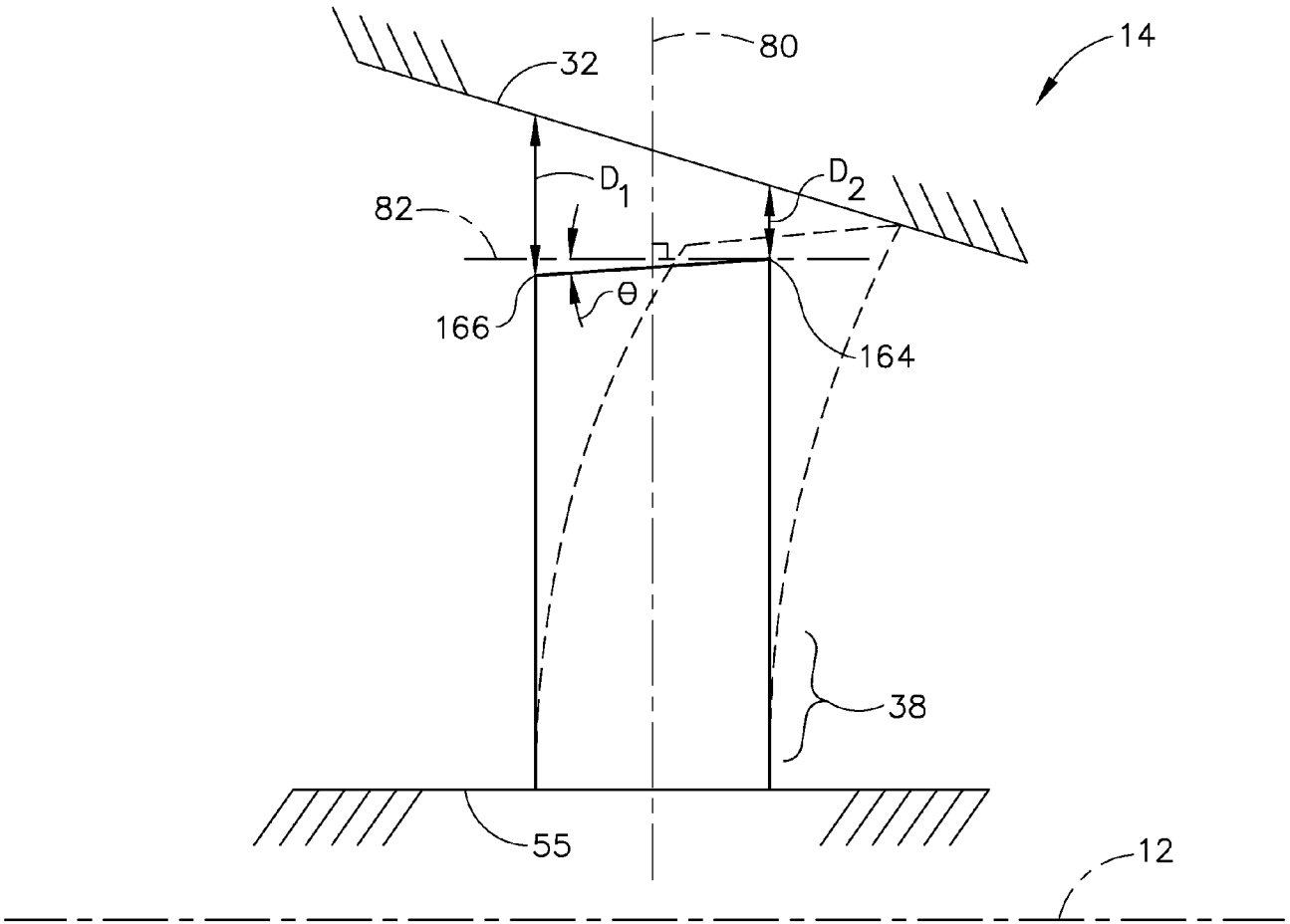
FIG. 5 is a cross-sectional view of the rotor blade shown in FIG. 4.

FIG. 4 illustrates an exemplary booster compressor blade 140 that is substantially similar to compressor blade 40 (shown in FIGS. 2 and 3). FIG. 5 illustrates a cross-sectional view of blade 140 installed in booster compressor 14. As such numbers used in FIGS. 2 and 3 will be used to indicate the same components in FIGS. 4 and 5. Specifically, in the exemplary embodiment, rotor blade tip portion 60 has been modified to create an exemplary compressor blade tip portion 160 that facilitates reducing radial loading induced to blade 140 if tip rubs occur during engine operation. Moreover in the exemplary embodiment, tip portion 160 includes a modified tip surface 162, concave edge 64, and a modified convex edge 166. In an alternative embodiment, concave edge 64 may be modified to form a modified concave edge 164 (shown in FIGS. 4 and 5).

In the exemplary embodiment, blade 140 has a stacking axis 80. Moreover, in the exemplary embodiment, stacking axis 80 extends through blade 140 in a span-wise direction from root portion 54 to tip portion 160. Generally, and in some embodiments, axis 80 is substantially parallel with a line (not shown) extending through blade 140 in a span-wise direction which is substantially centered along a chord-wise cross-section (not shown) of airfoil 42. Tip surface 162 extends obliquely between airfoil sides 44 and 46. More specifically, tip surface 162 is oriented at a rake angle Θ. Rake angle Θ of tip surface 162 is measured with respect to a plane 82 extending through rotor blade 140 substantially perpendicular to stacking axis 80. Plane 82, as described in more detail below, facilitates the fabrication and orientation of tip surface 162. In one embodiment, during a fabrication process, plane 82 is established using a plurality of datum points defined on an external surface of blade 140. Alternatively, blade tip surface 162 may be oriented at any rake angle Θ that enables blade 140 to function as described herein.

In the exemplary embodiment, the orientation of tip surface 162, as defined by rake angle Θ, causes the clearance gap 33 to be non-uniform across blade tip portion 160. Specifically, in the exemplary embodiment, because tip surface 162 is oriented at rake angle Θ, a height D1 of clearance gap 33 at convex edge 166 is greater than a height D2 of clearance gap 33 at concave edge 164. In the exemplary embodiment, surface 162 is formed via a raking process. Alternatively, surface 162 may be formed at rake angle Θ using any other known fabricating process, including but not limited to, a machining process.

In the exemplary embodiment, an existing blade 40 may be modified to include tip portion 160. Specifically, excess blade material from an existing blade tip portion 60 is removed via a raking process to form tip portion 160 with a corresponding rake angle Θ that facilitates prevention of convex edge 166 contact with abradable material 32 during a maximum blade dynamic response. More specifically, in the exemplary embodiment, rake angle Θ is between about 5° to about 15°. In an alternative embodiment, blade 140 is formed with tip portion 160 having rake angle Θ via a known casting process, such that tip portion 160 is formed with a desired rake angle Θ.

During normal engine operations, the rotor disk 20 rotates within an orbiting diameter that is substantially centered about longitudinal axis 12. Accordingly, rotor blades 140 rotate about longitudinal axis 12, and a sufficient clearance gap 33 is maintained between rotor blade tip portion 160 and abradable material 32. In the event blade 140 is deflected, tip portion 160 may inadvertently rub abradable material 32. As shown as hidden in FIG. 5, because tip portion 160 is oriented at rake angle Θ, during a tip rub, concave edge 164 contacts abradable material 32, rather than convex edge 166. As a result, during tip rubs, radial and axial loads induced to rotor blade 140 are facilitated to be reduced in comparison to other rotor blades 40. Moreover, dynamic stresses induced to blade 140, which may result in blade cracking at a first flex stress location 38 due to material fatigue, are also facilitated to be reduced. Specifically, loading and vibratory stresses induced to blade 140 are reduced because convex edge 166 is substantially prevented from rubbing abradable material 32 during tip rubs.

In the exemplary embodiment, rake angle Θ is selected to facilitate preventing blade tip surface 162 from contacting the abradable material 32. Rather, because of rake angle Θ, during tip rubs, generally only concave edge 164 will contact the abradable material 32, and moreover, the contact will be at an angle which facilitates edge 164 cutting and removing material 32 rather than jamming into the material 32. As a result, radial blade loading and the blade dynamic response are facilitated to be reduced.

The above-described rotor blade facilitates reducing radial and axial loading induced to the blade during inadvertent tip rubs between the rotor blades and the abradable material. Specifically, the tip portion is oriented at a rake angle that enables the concave edge to contact the abradable material rather than the convex edge of the airfoil. Contact with the concave edge facilitates reducing radial and axial forces induced to the blade, as well as the flex and vibration of the blade. Reduction of blade flex and vibrations induced to the blade reduces the dynamic response of the blade and the likelihood of material fatigue at the first flex stress location. As such, a useful life of the blade is facilitated to be increased in a cost-effective and reliable manner.

Exemplary embodiments of rotor blades are described above in detail. The rotor blades are not limited to the specific embodiments described herein, but rather, components of each assembly may be utilized independently and separately from other components described herein. For example, each rotor blade component can also be used in combination with other blade system components, with other gas and non-gas turbine engines.

While the invention has been described in terms of various specific embodiments, those skilled in the art will recognize that the invention can be practiced with modification within the spirit and scope of the claims.

What is claimed is:

1. A method for assembling a rotor assembly, said method comprising:

providing a rotor blade including a concave first sidewall and a convex second sidewall, wherein the first and second sidewalls are connected at a leading edge and a trailing edge and extend in span from a root portion to a tip portion;

removing blade material from the tip portion to form a planar tip portion oriented at an obtuse angle relative to the first sidewall and at an acute angle relative to the second sidewall such that, when the rotor blade is coupled within a casing, a distance measured between the casing and the planar tip portion at the first sidewall is larger than a distance measured between the casing and the planar tip portion at the second sidewall; and coupling the rotor blade to a shaft such that during tip rubs the orientation of the planar tip portion facilitates reducing radial loading induced to the rotor blade.

2. A method in accordance with claim 1, wherein removing blade material comprises raking material from the tip portion.

3. A method in accordance with claim 1, wherein removing blade material from the tip portion further comprises orienting the planar tip portion between about 5° to about 15° measured with respect to a plane that is substantially perpendicular to the span.

4. A blade comprising:

a concave first sidewall;

a convex second sidewall connected to said first sidewall at a leading edge and at a trailing edge; and a planar tip portion oriented at an obtuse angle relative to said first sidewall and at an acute angle relative to said second sidewall to facilitate reducing radial loading induced to said blade during tip rubs, where when coupled within a casing a distance measured between the casing and said planar tip portion at said first sidewall is larger than a distance measured between the casing and said planar tip portion at said second sidewall.

5. A blade in accordance with claim 4, wherein said planar tip portion is oriented at between about 5° to about 15° with respect to a plane that is perpendicular to a span of said blade.

6. A blade in accordance with claim 4, wherein said planar tip portion is formed via a raking process.

7. A blade in accordance with claim 4, wherein said blade is configured to be coupled within the casing such that an abradable surface of the casing is spaced apart from said blade, said planar tip portion configured such that said planar tip portion contacts the abradable surface of the casing at said second sidewall and does not contact the abradable surface at said first sidewall during tip rubs.

8. A rotor assembly for use in a gas turbine engine, said rotor assembly comprising:

a rotor shaft; and a plurality of rotor blades coupled to said rotor shaft such that each of said rotor blades comprises:

an airfoil portion comprising a concave first sidewall, a convex second sidewall connected to said first sidewall at a leading edge and at a trailing edge;

a root portion; and a planar tip portion oriented at an obtuse angle relative to said first sidewall and at an acute angle relative to said second sidewall to facilitate reducing radial loading induced to said airfoil portion during tip rubs, where said rotor assembly is configured to be coupled within the gas turbine engine such that an abradable surface extends circumferentially about said rotor assembly, said planar tip portion configured such that said planar tip portion contacts the abradable surface at said second sidewall and does not contact the abradable surface at said first sidewall during tip rubs.

9. A rotor assembly in accordance with claim 8, wherein said planar tip portion is formed via a raking process.

10. A rotor assembly in accordance with claim 8, wherein said rotor assembly is configured to be coupled within the gas turbine engine such that a distance measured between a casing of the gas turbine engine and said planar tip portion at said first sidewall is larger than a distance measured between the casing and said planar tip portion at said second sidewall.

* * * * *